United States Patent [19]

Sugimoto et al.

[11] Patent Number: 4,503,931

[45] Date of Patent: Mar. 12, 1985

[54] NOISE SUPPRESSING, AIR COOLED ENCLOSURE FOR AN ENGINE

[75] Inventors: Yutaka Sugimoto; Kenji Taira; Akira Fukushima, all of Komatsu, Japan

[73] Assignee: Kabushiki Kaisha Komatsu Seisakusho, Tokyo, Japan

[21] Appl. No.: 490,482

[22] Filed: May 2, 1983

[30] Foreign Application Priority Data

May 12, 1982 [JP] Japan ..... 57-78308
May 12, 1982 [JP] Japan ..... 57-67992[U]
May 12, 1982 [JP] Japan ..... 57-67993[U]

[51] Int. Cl.[3] ..... F01N 1/24

[52] U.S. Cl. ..... 181/204; 180/316; 123/198 E; 165/135

[58] Field of Search ..... 181/202, 203, 204, 284–286, 181/198; 180/68.4, 69.2; 123/198 E, 195 C, 41.7; 165/135

[56] References Cited

U.S. PATENT DOCUMENTS

| | | | |
|---|---|---|---|
| 3,856,439 | 12/1974 | Moehrbach | 181/204 |
| 3,866,580 | 2/1975 | Whitehurst et al. | 123/41.64 X |
| 4,071,009 | 1/1978 | Kraina | 123/198 E |
| 4,385,678 | 5/1983 | Cederbaum | 181/204 |

*Primary Examiner*—L. T. Hix
*Assistant Examiner*—Brian W. Brown
*Attorney, Agent, or Firm*—Frost & Jacobs

[57] ABSTRACT

A closed enclosure for a vehicle engine has an air inlet and an air outlet formed at its front and rear ends. Both air inlet and air outlet have sets of sound absorber blades for noiselessly admitting ambient cooling air into the enclosure and for noiselessly exhausting the air therefrom. Disposed horizontally within the enclosure, a first heat insulating partition divides its interior into an engine compartment accommodating the engine and, thereover, a muffler and air cleaner compartment. A second heat insulating partition is mounted vertically on the first partition to subdivide the muffler and air cleaner compartment into a muffler compartment receiving an exhaust muffler assembly and an air cleaner compartment receiving an air cleaner assembly. The engine compartment is open both forwardly and rearwardly for the passage of the cooling air therethrough. While the air cleaner compartment is closed, the muffler compartment is open forwardly to take in part of the ambient cooling air from the air inlet via another set of sound absorber blades. An additional pair of air outlets are defined in both sidewalls of the enclosure for the escape of the cooling air from the muffler compartment.

11 Claims, 8 Drawing Figures

NOISE SUPPRESSING, AIR COOLED ENCLOSURE FOR AN ENGINE

BACKGROUND OF THE INVENTION

Our invention pertains to enclosures for power plants or engines, such as those of earthmoving vehicles, and deals more specifically with such an enclosure capable of drastically attenuating the noise emanating from the power plant while admitting of sufficient airflow for its cooling.

Bulldozers and like earthmoving vehicles employ large internal combustion engines and associated power plant components which give off very substantial noise. The earthmoving industry has made various attempts to suppress the noise levels of such vehicle power plants. Most conventional attempts have taken the form of power plant enclosures with a variety of soundproofing facilities. Soundproof enclosures, however, inevitably run counter to another requirement of air cooling the engine. Diffuculties have been encountered in designing power plant enclosures meeting the self contradictory requirement of mitigating the noise levels of the power plant and providing sufficient cooling airflow for its normal operation.

Whitehurst et al. U.S. Pat. No. 3,866,580, dated Feb. 18, 1975, and Kraina U.S. Pat. No. 4,071,009, dated Jan. 31, 1978, are typical of conventional attempts at the provision of engine enclosures fulfilling the above self contradictory objective. These known devices seem to us to leave room for further refinement.

SUMMARY OF THE INVENTION

Our invention provides an advanced enclosure for an internal combustion engine and its attachments, with or without other power plant components, which is capable of reducing to a minimum the noise generated thereby and of allowing them to be air-cooled most effectively.

Broadly the engine enclosure of our invention comprises wall means mounted on a frame to define a substantially closed space. At first and second ends of the wall means there are air inlet means for noiselessly admitting ambient cooling air into the closed space, and air outlet means for noiselessly exhausting the cooling air from the closed space. Disposed horizontally within the wall means, a heat insulating partition divides the internal space thereof into an engine compartment accommodating an internal combustion engine and an overlying muffler compartment accommodating an exhaust muffler assembly of the engine. The engine compartment is open toward both first and second ends of the wall means to allow the cooling air to flow therethrough from the air inlet means to the air outlet means for cooling the engine. The muffler compartment, on the other hand, is open only toward the first end of the wall means to take in part of the cooling air from the air inlet means for cooling the exhaust muffler assembly. The wall means has additional air outlet means conveniently positioned thereon for exhausting the cooling air from the muffler compartment.

As summarized in the foregoing, our invention calls for the arrangement of the engine proper and its muffler assembly, the two principal heat sources of an internal combustion engine system, in the separate compartments which are heat insulated from each other. The engine compartment and the muffler compartment are both open to the air inlet means at the first, or forward, end of the wall means and have their own air outlet means. The streams of air through the two compartments are therefore sufficient to cool the engine and the muffler assembly. Further the heat insulating partition between the two compartments functions to prevent the heat emanating from the muffler assembly from adversely affecting the performance of the engine.

Accoding to a further feature of our invention the engine communicates with the muffler assembly by way of a flexible conduit extending through the heat insulating partition. As the engine and the muffler assembly are housed in the separate compartments as above, they inevitably vibrate in different modes. The flexible conduit communicating the engine with the muffler assembly serves to effectively damp the audible vibrations of the engine, preventing their transmission to the muffler assembly. As an additional advantage the flexible conduit will offer a much longer working life than if it were rigid.

A still further feature of our invention resides in sound absorbing means provided to the air inlet means and air outlet means at the ends of the wall means and at the entrance of the muffler compartment. In a preferred embodiment the sound absorbing means take the form of what are herein termed "sound absorber blades", each comprising a mass of glass wool or like sound absorbing material enclosed in a suitable open worked covering. Mounted in space apart positions, each set of sound absorber blades allows air to flow noiselessly therepast into or out of the engine compartment or into the muffler compartment. The sound absorber blades also function to absorb the noise generated by the engine and the muffler assembly.

Thus the improved enclosure of our invention effectively attenuates the noise levels of the enclosed engine or power plant. Despite its substantially closed construction, moreover, the enclosure eliminates the danger of engine overheating.

The above and other features and advantages of our invention and the manner of attaining them will become more apparent, and the invention itself will best be understood, from a study of the following description of a preferred embodiment and appended claims, with reference had to the attached drawings.

DESCRIPTION OF THE PREFERRED EMBODIMENT

Figure 1:
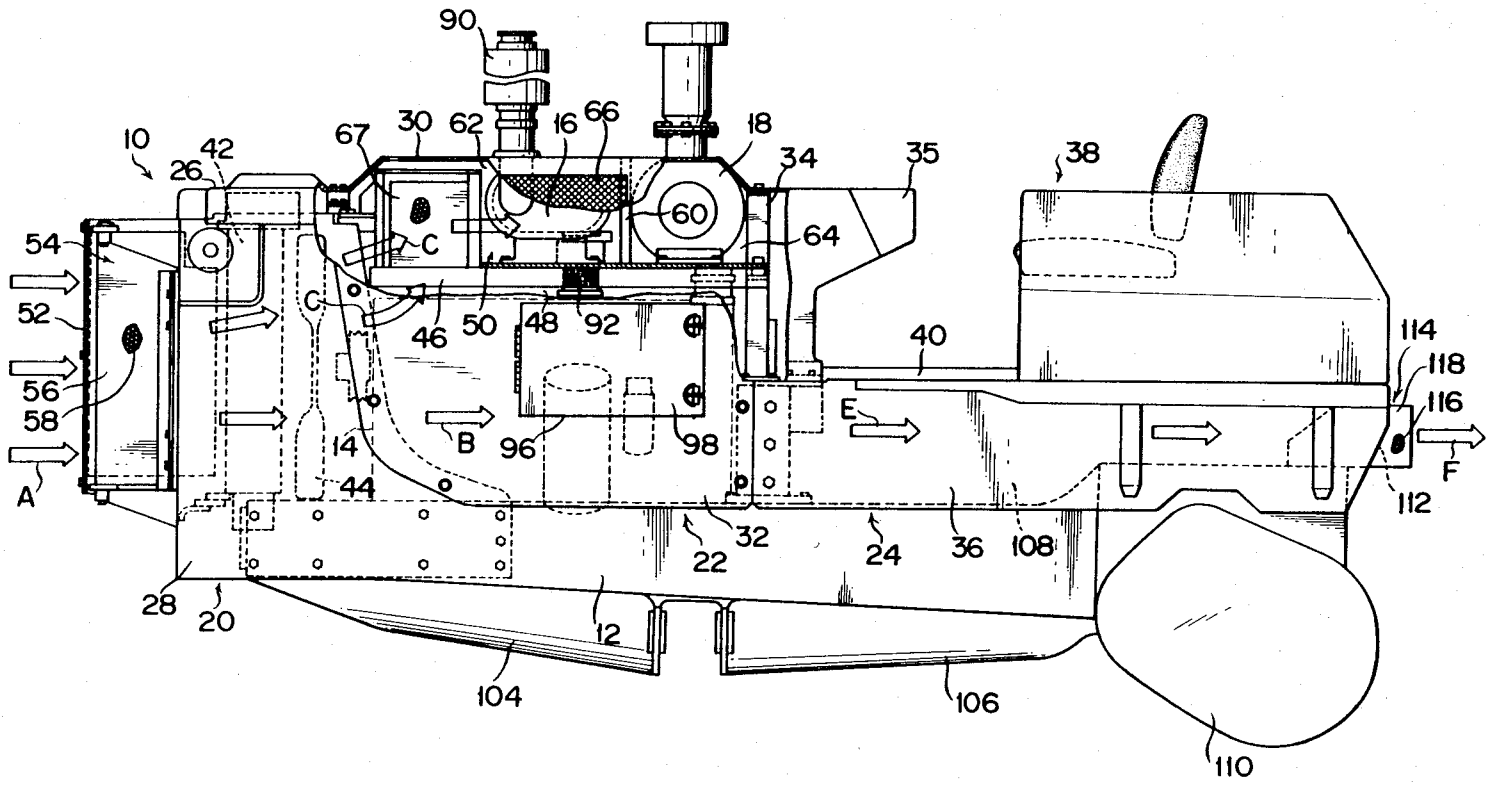
FIG. 1 is a side elevation, with parts shown broken away to reveal other parts, of the noise suppressing, air cooled enclosure of our invention as adapted for use on an earthmoving vehicle.
Figure 2:
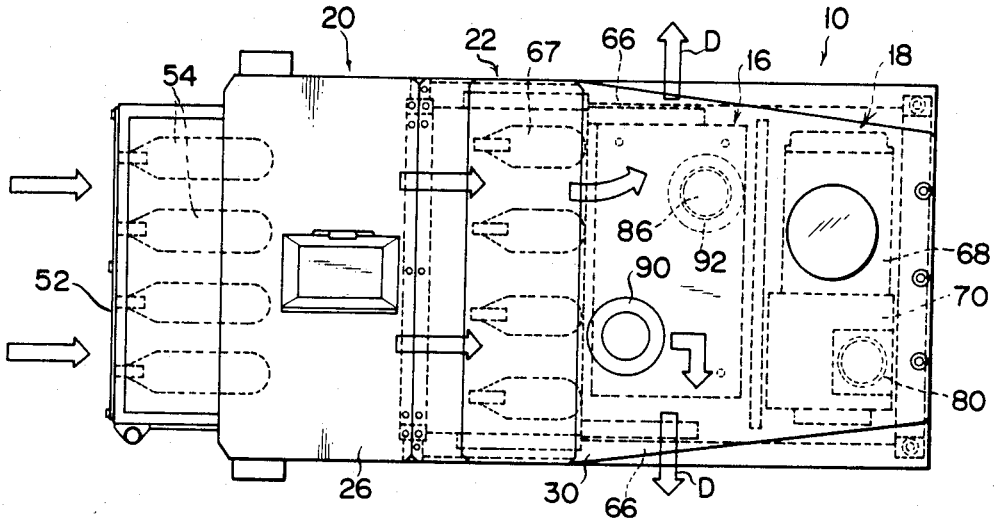
FIG. 2 is a partial top plan of the enclosure of FIG. 1.
Figure 3:
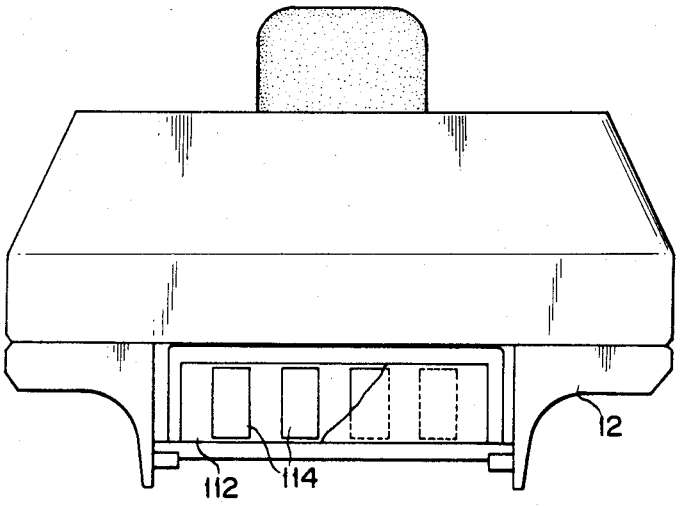
FIG. 3 is a rear end elevation of the enclosure of FIG. 1.

Reference is first directed to FIGS. 1, 2 and 3 in order to describe the general organization of the noise suppressing, air cooled enclosure embodying the principls of our invention. Generally referenced 10, the enclosure is shown in these drawings as mounted on a frame 12 of an earthmoving vehicle for housing an engine 14, an engine exhaust muffler assembly 16, an engine air cleaner assembly 18, and other power plant components normally employed for powering vehicles of this class.

The enclosure 10 broadly comprises a forward section 20, a central section 22, and a rearward section 24. These discrete sections of the enclosure are lap jointed to each other in a manner to be detailed subsequently. The forward enclosure section 20 comprises a ceiling 26 and a pair of sidewalls 28 depending from the opposite sides of the ceiling. The central enclosure section 22 also comprises a ceiling 30 and a pair of sidewalls 32 depending from its opposite sides. The ceiling 30 has its front edge lap jointed to the ceiling 26 of the forward enclosure section 20 and its rear edge fastened to an upstanding frame 34 disposed just forwardly of a control console 35. The rearward enclosure section 24 comprises a pair of sidewalls 36 having their front edges lap jointed to the sidewalls 32 of the central enclosure section 22. Overlying the rearward enclosure section 24 is an operator's station 38 having a floor 40 which forms the top of the rearward enclosure section.

The forward enclosure section 20 defines a space for accommodating the radiator 42 and cooling fan 44 of the engine 14. The central enclosure section 22 has its internal space divided by a heat insulating partition 46 into a lower space for the installation of the engine 14 and an upper space for the installation of the exhaust muffler assembly 16 and air cleaner assembly 18. We will give the name "engine compartment", designated 48 in FIG. 1, to the enclosed spaces accommodating the engine 14, radiator 42, and cooling fan 44. Also we will refer to the upper enclosed space of the partition 46 as the "muffler and air cleaner compartment" and give it the reference numeral 50.

The following is the more detailed discussions of the forward section 20, central section 22, and rearward section 24 of the enclosure 10, in that order. The description of operation will follow such detailed discussions of enclosure construction.

Arranged forwardly of the forward enclosure section 20 is an air inlet 52 for the intake of ambient cooling air into the engine compartment 48 and the muffler and air cleaner compartment 50. As depicted in both FIGS. 1 and 2, the air inlet 52 has a plurality of sound absorber blades 54 mounted vertically therein at constant transverse spacings. Each sound absorber blade 54 comprises a mass of any standard sound absorbing material such as glass wool 56 filled in a reticulate or like openwork covering 58. Generally flat, each sound absorber blade may be suitably streamlined; for instance, it is shown to be approximately spindle shaped as seen in a plan view as in FIG. 2. The set of sound absorber blades 54 as a whole functions to allow ambient air to pass noiselessly into the enclosure 10 and to suppress the noise emanating from the enclosed power plant.

Lying immediately behind the set of sound absorber blades are the radiator 42 and, further behind it, the engine driven fan 44, both surrounded by the forward enclosure section 20. Ambient air is thus drawn noiselessly into the enclosure 10 through the inlet 52, as indicated by the open arrows A in FIG. 1.

The central enclosure section 22 has its interior divided as aforesaid into the engine compartment 48 and the muffler and air cleaner compartment 50 by the heat insulating partition 46 disposed horizontally over the engine 14. Further, in the illustrated embodiment, a second heat insulating partition 60 is placed upstandingly on the first recited partition 46. This second partition subdivides the muffler and air cleaner compartment 50 into a muffler compartment 62 and an air cleaner compartment 64, with the former arranged forwardly of the latter. The muffler compartment 62 accommodates the exhaust muffler assembly 16, and the air cleaner compartment 64 the air cleaner assembly 18. The muffler compartment is open forwardly whereas the air cleaner compartment is thoroughly closed.

Thus the incoming cooling air flows partly into the engine compartment 48 for cooling the engine 14, as shown by the arrows B, and partly into the muffler compartment 62 for cooling the mufler assembly 16 (arrows C). The muffler compartment 62 has a pair of open worked air outlets 66 defined in the opposed sidewalls 32 of the central enclosure section 22. The arrows D in FIG. 2 indicate the air streams egressing from the muffler compartment 62 through the outlets 66.

Forwardly of the muffler assembly 16 there is mounted a set of transversely spaced sound absorber blades 67 which are analogous in construction with the set of sound absorber blades 54 in the air inlet 52 of the enclosure 10. The sound absorber blades 67 function to mitigate the noise of the airflow C being forced therethrough into the muffler compartment 62 by the cooling fan 44. The airflow C is directed toward the set of sound absorber blades 67 both from its front and bottom.

Figure 4:
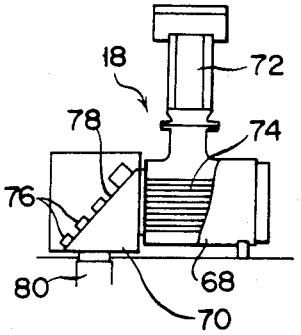
FIG. 4 is an elevation, partly shown broken away for illustrative convenience, of the air cleaner assembly of the engine housed in the enclosure of FIG. 1.

FIG. 4 illustrates in detail the air cleaner assembly 18 in the air cleaner compartment 64. It comprises an air cleaner proper 68 and a resonator 70 attached thereto. The cleaner proper 68 has an intake muffler 72 extending upwardly therefrom and projecting outwardly through the ceiling 30 of the central enclosure section 22. A filter element 74 in the cleaner proper 68 filters the air incoming through the intake muffler 72. Connected downstream of the cleaner proper 68, the resonator 70 has a plurality of multiplicity of tubes 76 of different diameters and lengths mounted on a sloping partition 78 for absorbing noise components of various frequencies as the filtered air passes into the engine through a conduit 80 extending downwardly from the resonator.

Figure 5:
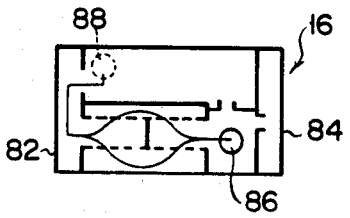
FIG. 5 is a schematic horizontal section through the exhaust muffler assembly of the engine housed in the enclosure of FIG. 1.

FIG. 5 is a schematic representation of the exhaust muffler assembly 16 in the muffler compartment 62. It integrally comprises a muffler proper 82 and a resonator 84 coacting to deaden the noise of the exhaust gases from the engine. The muffler proper 82 has an exhaust inlet 86 and an exhaust outlet 88. The exhaust outlet communicates with ambient by way of an exhaust stack 90, FIGS. 1 and 2, extending upwardly through the ceiling 30 of the central enclosure section 22.

Figure 6:
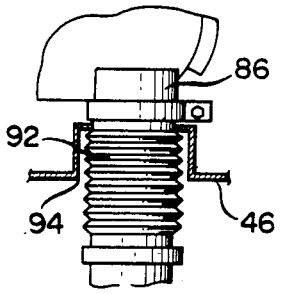
FIG. 6 is an enlarged elevation, partly shown in section for illustrative convenience, showing in particular the flexible conduit communicating the engine of FIG. 1 with the exhaust muffler assembly of FIG. 5.

In FIG. 6 is shown on an enlarged scale a flexible conduit 93 communicating the inlet 86 of the muffler proper 82 with the exhaust manifold, not shown, of the engine in accordance with one of the features of our invention. Shown to be in the form of a tubular bellows, the flexible conduit 92 extends through an opening 94 in the first heat insulating partition 46 in a manner well calculated to isolate the muffler assembly 16 from the engine 14 in terms of vibrations. We have already set forth the advantages accruing from use of the flexible conduit 92 for the delivery of exhaust gases from engine 14 to muffler assembly 16.

Figure 8:
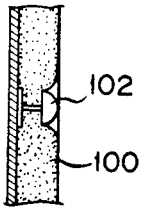
FIG. 8 is an enlarged, fragmentary section through one of the lap joints between the constituent wall sections of the enclosure of FIG. 1 and between the wall sections and other parts of the vehicle.

With reference back to FIG. 1 in particular, the pair of sidewalls 32 of the central enclosure section 22 bounding the engine compartment 48 have both windows 96 formed therein for engine servicing purposes. These windows are covered by hinged, solid access panels 98. The walls of the central enclosure section, as well as those of the other sections, have linings 100, FIG. 8, of any standard sound absorbing material secured thereto as by fasteners 102 wherever required. Similar sound absorbing linings may be provided on the vehicle frame 12 and on its front 104 and rear 106 undercovers as required.

The pair of sidewalls 36 of the rearward enclosure section 24 have their front edges joined to the rear edges of the central enclosure section sidewalls 32. In combination with the vehicle frame 12, the operator's station floor 40, and the rear undercover 106, the rearward enclosure section sidewalls 36 define an air passageway or power train compartment 108 directly communicating with an extending rearwardly from the engine compartment 48. As the name implies, the power train compartment 108 accommodates a power train, not shown, for transmitting the output torque of the engine 14 to a final drive unit 110. The arrows E in FIG. 1 denote airflow through the power train compartment.

As seen in both FIGS. 1 and 3, the rearward enclosure section 24 has an air outlet 112 at its rear end for the exhaust to ambient of the cooling air that has traversed the engine compartment 48 and the power train compartment 108. The air outlet 112 also has a plurality of sound absorber blades 114 mounted at transverse spacings therein. Like the sets of sound absorber blades 54 and 67 at the air inlet 52 of the enclosure 10 and at the entrance of the muffler compartment 62, the set of sound absorber blades 114 each comprise a mass of sound absorbing material 116 filled in an open worked covering 118. Accordingly the cooling air flows noiselessly out of the air outlet 112, as indicated by the arrow F in FIG. 1.

It will have been seen that the engine compartment 48 is open both forwardly and rearwardly to allow cooling air to flow therethrough from air inlet 52 to air outlet 112. The muffler compartment 62, on the other hand, is open forwardly and laterally to allow cooling air to flow therethrough from air inlet 52 to air outlets 66.

Figure 7:
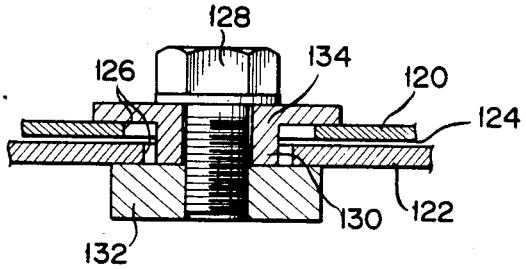
FIG. 7 is an enlarged, fragmentary section through a representative one of the constituent walls of the enclosure of FIG. 1, shown together with a layer of sound absorbing material lining the wall.

FIG. 7 is an illustration of one of the joints between the three sections 20, 22 and 24 of the enclosure 10, between the enclosure and the vehicle frame 12, and between any other pertinent parts of the vehicle. The reference numerals 120 and 122 in FIG. 7 denote the lapping edges of any two such parts to be joined in accordance with our invention. It will be observed that the lapping edges 120 and 122 are suitably spaced from each other with means (not shown) therebetween to provide a gap 124 therebetween. Further the lapping edges have clearance holes 126 formed therein to loosely receive a bolt 128 with a flanged sleeve 130 fitted thereon. A nut 132 is tightened on the end of the bolt 128 projecting out of the sleeve 130, so that the lapping edges 120 and 122 are caught between the nut 132 and the flange 134 of the sleeve 130.

Thus lap jointed, the two members are substantially physically isolated from each other. The vibration of one member is therefore not directly transmitted to the other, resulting in the reduction of audible vibration of the enclosure 10 and other related parts. The improved enclosure of our invention itself produces less noise than most conventional ones.

Operation

In the operation of the vehicle incorporating the noise suppressing, air cooled enclosure 10 of our invention, the engine driven fan 44 assists the ingress of ambient air into the enclosure through the air inlet 52 (arrows A). The set of sound absorber blades 54 in this air inlet absorbs noise from the incoming air. Drawn into the enclosure 10, the cooling air first passes the radiator 42 for cooling the water on other suitable coolant circulating therethrough for engine cooling purposes.

The cooling fan 44, positioned downstream of the radiator 42, directs part of the incoming cooling air further through the engine compartment 48 (arrows B) and the rest of the air toward the muffler compartment 62 (arrows C). The airflow B through the engine compartment 48 cools the engine 14 and then enters the power train compartment 108 for cooling the unshown power train (arrows E). Then the airflow egresses from the enclosure 10 through its outlet 112, with its noise suppressed by the set of sound absorber blades 114.

Directed toward the muffler compartment 62, the airflow C passes the set of sound absorber blades 67 thereby to have its noise reduced. Thus the airflow C noiselessly enters the muffler compartment 62 and cools the exhaust muffler assembly 16 contained therein, which is heat insulated from the engine 14 by the first partition 46 and from the air cleaner assembly 18 by the second partition 60. Thereafter the cooling air leaves the enclosure 10 through the pair of screened outlets 66 on the opposite sides of the muffler compartment 62.

From the foregoing it is clear that the disclosed embodiment is well designed to accomplish the dual objective of minimizing the noise level of the power plant and most efficiently air cooling the engine proper, its exhaust muffler assembly, and other power plant components. We wish to have it understood, however, that this embodiment is by way of illustation or explanation only. For our invention might be embodied in other forms to conform to design considerations or preferences or to meet specific requirements of its applications, without departing from the spirit or scope of the invention as expressed in the following claims.

We claim:

1. A noise suppressing, air cooled enclosure mounted on a frame and generally surrounding an internal combustion engine supported thereon, the engine having an exhaust muffler assembly and an air cleaner assembly arranged thereover, the enclosure comprising:

(a) wall means mounted on the frame to define a substantially closed space;

(b) air inlet means at a first end of the wall means for noiselessly admitting cooling air into the closed space;

(c) first air outlet means at a second end of the wall means for noiselessly exhausting the cooling air from the closed space;

(d) a heat insulating partition disposed horizontally within the wall means to divide the closed space defined thereby into an engine compartment accommodating the engine and, thereover, a muffler compartment accommodating the exhaust muffler assembly, the engine compartment being open toward both the first and second ends of the wall means to allow the cooling air to flow therethrough from the air inlet means to the air outlet means for cooling the engine, the muffler compartment being open toward the first end of the wall means to take in part of the cooling air from the air inlet means for cooling the exhuast muffler assembly, said air cleaner assembly being mounted on said partition behind the exhaust muffler assembly with respect to the first end of the wall means; and (e) second air outlet means in the wall means for exhausting the cooling air from the muffler compartment.

2. The noise suppressing, air cooled enclosure as recited in claim 1, further comprising a second heat insulating partition between the exhaust muffler assembly and the air cleaner assembly for defining a closed air cleaner compartment separate from the muffler compartment.

3. The noise suppressing, air cooled enclosure as recited in claim 1, wherein the exhaust muffler assembly communicates with the engine by way of a flexible conduit extending through the heat insulating partition.

4. THe noise suppressing, air cooled enclosure as recited in claim 1, further comprising sound absorbing means positioned forwardly of the exhaust muffler assembly with respect to the first end of the wall means for reducing the noise of the cooling air passing therethrough into the muffler compartment.

5. The noise suppressing, air cooled enclosure as recited in claim 4, wherein the sound absorbing means comprises a plurality of spaced apart sound absorber blades each having a mass of sound absorbing material enclosed in an open worked covering.

6. The noise suppressing, air cooled enclosure as recited in claim 1, wherein each of the air inlet means and the first air outlet means comprises a plurality of spaced apart sound absorber blades for reducing the noise of the air passing therethrough, each sound absorber blade having a mass of sound absorbing material enclosed in an open worked covering.

7. The noise suppressing, air cooled enclosure as recited in claim 1, wherein the wall means comprises linings of sound absorbing material.

8. A noise suppressing, air cooled enclosure system comprising:

(a) a vehicle frame;

(b) an engine supported on the vehicle frame and having a muffler assembly and an air cleaner assembly arranged thereover;

(c) wall means mounted on the vehicle frame to provide a substantially closed space;

(d) air inlet means positioned forwardly of the wall means for noiselessly admitting ambient cooling air into the closed space;

(e) first air outlet means positioned rearwardly of the wall means for noiselessly exhausting the cooling air from the closed space;

(f) a first partition disposed horizontally within the wall means to divide the closed space into an engine compartment accommodating the engine and, thereover, a muffler and air cleaner compartment accommodating the muffler assembly and the air cleaner assembly, the engine compartment being open both forwardly and rearwardly to allow the cooling air to flow therethrough from the air inlet means to the first air outlet means for cooling the engine;

(g) a second partition disposed vertically on the first partition to subdivide the muffler and air cleaner compartment into a muffler compartment and air cleaner compartment, the muffler compartment being disposed forwardly of the air cleaner compartment and being open forwardly to take in part of the cooling air from the air inlet means for cooling the muffler assembly accommodated therein;

(h) a flexible conduit extending through the first partition for communicating the engine with the muffler assembly; and (i) second air outlet means in the wall means for exhausting the cooling air from the muffler compartment.

9. The noise suppressing, air cooled enclosure system as recited in claim 8, wherein the first and second partitions are both capable of insulating heat.

10. The noise suppressing, air cooled enclosure system as recited in claim 8, wherein the muffler assembly comprises a muffler proper through which there flow the exhaust gases from the engine, and a resonator attached to the muffler proper and coacting therewith to deaden the noise of the engine exhaust gases.

11. The noise suppressing, air cooled enclosure system as recited in claim 8, wherein the air cleaner assembly comprises an air cleaner proper for filtering ambient air to be drawn into the engine, and a resonator attached to the air cleaner for muffling the noise of the filtered air as the same is drawn into the engine.

* * * * *